US008099011B2

(12) United States Patent
Toda et al.

(10) Patent No.: US 8,099,011 B2
(45) Date of Patent: Jan. 17, 2012

(54) IMAGE FORMING APPARATUS

(75) Inventors: Atsushi Toda, Mishima (JP); Masanobu Saito, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 634 days.

(21) Appl. No.: 11/954,059

(22) Filed: Dec. 11, 2007

(65) Prior Publication Data

US 2008/0145075 A1 Jun. 19, 2008

(30) Foreign Application Priority Data

Dec. 13, 2006 (JP) ..... 2006-336009
Oct. 17, 2007 (JP) ..... 2007-270085

(51) Int. Cl.
*G03G 15/00* (2006.01)

(52) U.S. Cl. ..... 399/89; 399/37; 399/88; 399/310; 399/314

(58) Field of Classification Search ..... 399/37, 399/38, 50, 88, 89, 297, 310, 314
See application file for complete search history.

(56) References Cited

U.S. PATENT DOCUMENTS 5,636,009 A * 6/1997 Honda et al. ..... 399/50
5,842,081 A * 11/1998 Kaname et al. ..... 399/50
7,103,294 B2 * 9/2006 Kawano ..... 399/55
2002/0102108 A1 * 8/2002 Adachi et al. ..... 399/50
2003/0228172 A1 * 12/2003 Nakamura et al. ..... 399/174
2005/0158061 A1 * 7/2005 Do ..... 399/44

FOREIGN PATENT DOCUMENTS

JP 3214120 A 7/2001

* cited by examiner

*Primary Examiner* — David Porta
*Assistant Examiner* — Jessica L Eley
(74) *Attorney, Agent, or Firm* — Canon U.S.A., Inc. IP Division

(57) ABSTRACT

Embodiments of the present invention include an image bearing member arranged to bear an electrostatic latent image, a charging member contacting the image bearing member to charge a surface of the image bearing member with application of a DC voltage to the charging member, a current detection unit arranged to detect a DC current flowing in the charging member, and a control unit configured to control the voltage applied to the charging member, wherein a plurality of different DC voltages are successively applied to the charging member during a period of no image formation until a change amount of change in the DC current with respect to change in the DC voltage becomes not larger than a predetermined value, and the control unit controls a DC voltage applied to the charging member during a period of image formation based on a result detected by the current detection unit.

4 Claims, 14 Drawing Sheets

IMAGE FORMING APPARATUS

BACKGROUND OF THE INVENTION

1. Field of the Invention

The present invention primarily relates to an image forming apparatus utilizing an electrophotographic method. The image forming apparatus is, for example, an electrophotographic copying machine, an electrophotographic printer (such as an LED printer and a laser beam printer), or an electrophotographic facsimile machine.

2. Description of the Related Art

Hitherto, in image forming apparatuses such as an electrophotographic copying machine and printer, contact charging is performed by discharge from a charging member to a charged member (image bearing member). Therefore, the charging to the image bearing member is started by applying a voltage of not lower than a certain threshold value to the charging member. For example, when a charging roller (charging member) is pressed and contacted with an OPC photosensitive member (image bearing member) having a predetermined thickness, the surface potential of the photosensitive member starts to rise by applying a voltage of not lower than the discharge start voltage. Thereafter, the surface potential of the photosensitive member is linearly increased at a gradient of 1 with respect to the applied voltage. In the following description, the threshold voltage at which the discharge is started is defined as the discharge start voltage Vth.

In order to obtain a desired surface potential Vd of the photosensitive member, therefore, a voltage of Vd+Vth is required to be applied to the charging roller.

That principle can be explained as follows. The charging roller, an air layer formed by a minute gap between the charging roller and the photosensitive member, and the photosensitive member can be expressed by an electric equivalent circuit.

The impedance of the charging roller is not handled here because it is so small as to be negligible compared to the impedance of each of the photosensitive member and the air layer. In other words, a charging mechanism can be expressed just by using two capacitors C1 and C2 (C1 represents the electrostatic capacitance of the photosensitive member and C2 represents the electrostatic capacitance of the air layer).

When a DC voltage V is applied to the equivalent circuit, the applied voltage is distributed to the capacitors in proportion to their impedances. Thus, the voltage applied to the air layer A is given by:

$$V\text{air}=C1/(C1+C2) \quad (1)$$

The air layer A has a dielectric breakdown voltage according to the Paschen's law. Assuming the thickness of the air layer A to be d [μm], therefore, discharge occurs and charging is started when Vair exceeds:

$$312+6.2d\ [V] \quad (2)$$

The voltage at which the discharge first occurs is given when a quadratic equation with a variable d has a multiple root on condition that the formula (1) and the formula (2) are equal to each other (C2 is also a function of d). V satisfying the above assumption corresponds to the discharge start voltage Vth. A thus-obtained theoretical value of the discharge start voltage Vth shows a very good match with an experimental value.

Further, in a constant-voltage control circuit, Vth is not changed regardless of change in the process speed (i.e., the peripheral speed of the photosensitive member). Such a property can be explained based on the following relation formulae (3) and (4);

$$I=\in\cdot\in 0\cdot L\cdot Vp\cdot Vd/d \quad (3)$$

(I: charging current, ∈: dielectric constant of the photosensitive member, ∈0: dielectric constant in vacuum, L: effective charging width, Vp: process speed, Vd: surface potential of the photosensitive member, and d: film thickness of the photosensitive member), and $$V=((d/\in\cdot L\cdot Vp)+R))I-Vth \quad (4)$$

(V: applied voltage to the charging roller, d: film thickness of the photosensitive member, ∈: dielectric constant of the photosensitive member, L: effective charging width, Vp: process speed, R: resistance value of the charging roller, I: charging current, and Vth: discharge start voltage).

In the constant-voltage control circuit, as seen from the formula (3), the process speed and the charging current are proportional to each other. Hence, as the process speed increases, the charging current is also increased proportionally. Further, since the relationship among the applied voltage, the surface potential of the photosensitive member, and Vth is expressed by the formula (4), the process speed and the charging current are canceled to each other, thus resulting in no changes in V and Vth.

Accordingly, in the constant-voltage control circuit, Vth is not changed regardless of change in the process speed (see FIG. 2). Moreover, at voltages of not lower than Vth, it is understood that the applied voltage and the surface potential of the photosensitive member is in a linear relation with a gradient of 1.

However, Vth is changed (see FIGS. 3 and 4) if the electrostatic capacitance C1 of the charged member is changed due to abrasion with the use for a long time (i.e., change in film thickness of the surface member), or if the electrostatic capacitance of the charging roller is changed due to environmental changes.

If the electrostatic capacitance C1 of the charged member is changed due to, e.g., abrasion with the use for a long time (i.e., change in film thickness of the surface layer of the photosensitive member), the discharge start voltage Vth is changed and the charged potential of the charged member is also changed with the change of Vth. In the case of an image forming apparatus, if the electrostatic capacitance C1 is changed due to, e.g., abrasion of the surface of the photosensitive member which is caused with the continued use of an image bearing member (photosensitive member) serving as the charged member, Vth is changed. The change of Vth may shift the charged potential from an initially set desired value and may disturb an image.

Stated another way, when charging is performed at a constant voltage based on the above-described contact charging principle, Vth is changed if the photosensitive member is abraded and the electrostatic capacitance C1 of the photosensitive member is changed. More specifically, because of the relationship of $$C1=\in S/t$$

(∈: dielectric constant of the photosensitive member, S: discharge area (constant), and t: thickness of the photosensitive member), C1 is increased if the thickness of the photosensitive member is reduced.

On the other hand, the impedance of the photosensitive member is inversely proportional to C1. Therefore, if the thickness of the photosensitive member is reduced (C1 is increased), the voltage applied to the photosensitive member is reduced and the voltage applied to the air layer is increased on the contrary. This means that, even with the application of the same voltage V, the discharge is more apt to occur and a value of Vth is necessarily reduced after the use for a long time.

Further, in a low-temperature and low-moisture environment (environment at 15° C. and 10% RH or below in the present invention, hereinafter referred to as an L/L environment), the electrostatic capacitance of the charging roller is changed although it is negligible in a normal-temperature and normal-moisture environment (N/N environment). Such a change increases the impedance of the charging roller. Therefore, an extra voltage is required to start the discharge and Vth is increased correspondingly.

In an image forming apparatus utilizing the contact charging, when the apparatus is controlled as usual by employing a constant voltage of (Vd+Vth), which is usually obtained in an initial state of the environment, while ignoring the influence of sheet passage in the use and the influence of the environment, Vth is reduced and Vd is increased if the film thickness of the surface layer of the photosensitive member is decreased with the use. Also, in the L/L environment, because Vth is increased, Vd is reduced. Anyway, there arises a problem that an image is changed. To cope with such a problem, voltage control using an expensive sensor, e.g., an environment sensor, is required.

As the related art addressing the above-mentioned problem, Japanese Patent No. 3214120 proposes a known method of suppressing a variation in potential of an image bearing member, which is caused by environmental variations and a variation in film thickness of the image bearing member. With the proposed known method, a DC voltage is applied to a charging member and a value of the applied voltage is detected at the time when a small current of not larger than 0.5 μA flows between the charging member and the image bearing member. The voltage detected at that time is regarded as a value almost close to the discharge start voltage. By performing voltage control using a value that is obtained by adding a predetermined voltage to the detected voltage, the potential of the image bearing member is held constant regardless of the environmental variations and the variation in film thickness of the image bearing member.

SUMMARY OF THE INVENTION

The present invention is directed to an image forming apparatus utilizing an electrophotographic method. Embodiments of the present invention can be described as an image forming apparatus comprising an image bearing member arranged to bear an electrostatic latent image; a charging member contacting the image bearing member to charge a surface of the image bearing member with application of a DC voltage to the charging member; a current detection unit arranged to detect a DC current flowing in the charging member; and a control unit configured to control the voltage applied to the charging member, wherein a plurality of different DC voltages are successively applied to the charging member during a period of no image formation until a change amount of change in the DC current with respect to change in the DC voltage becomes not larger than a predetermined value, and the control unit controls a DC voltage applied to the charging member during a period of image formation based on a result detected by the current detection unit.

Further features of the present invention will become apparent from the following description of exemplary embodiments with reference to the attached drawings.

DESCRIPTION OF THE EMBODIMENTS

Figure 1:
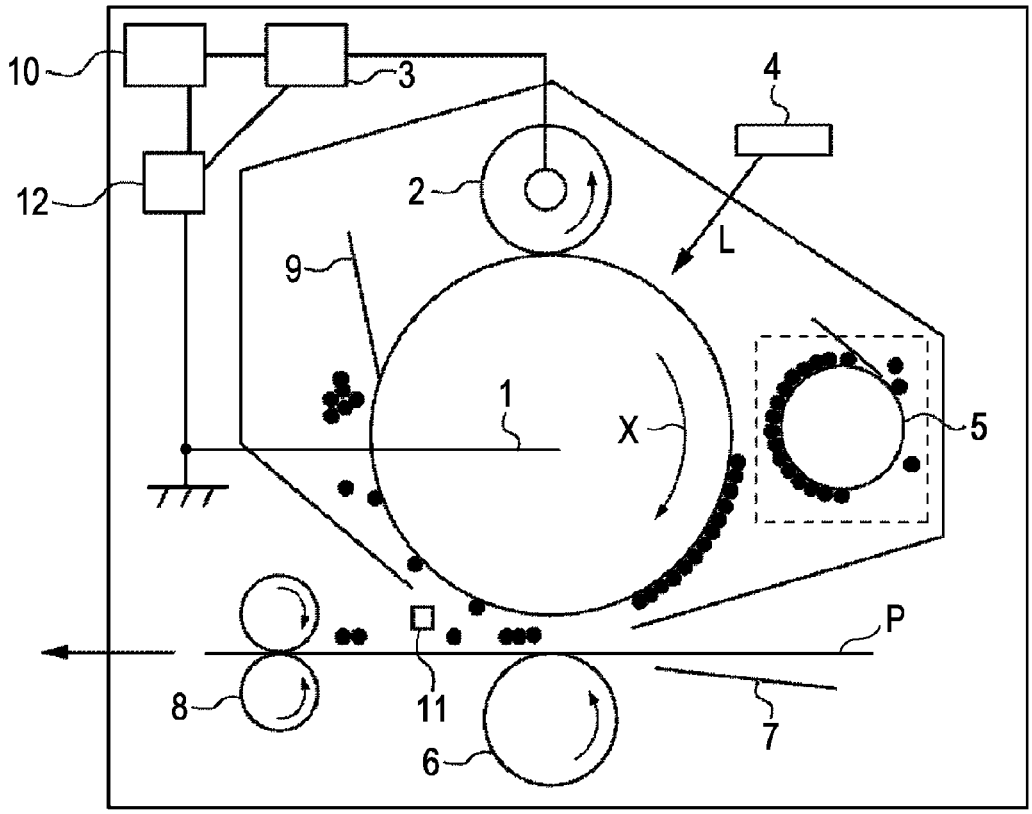
FIG. 1 is a schematic vertical sectional view of a process cartridge mounted to an image forming apparatus according to a first exemplary embodiment of the present invention.
Figure 2:
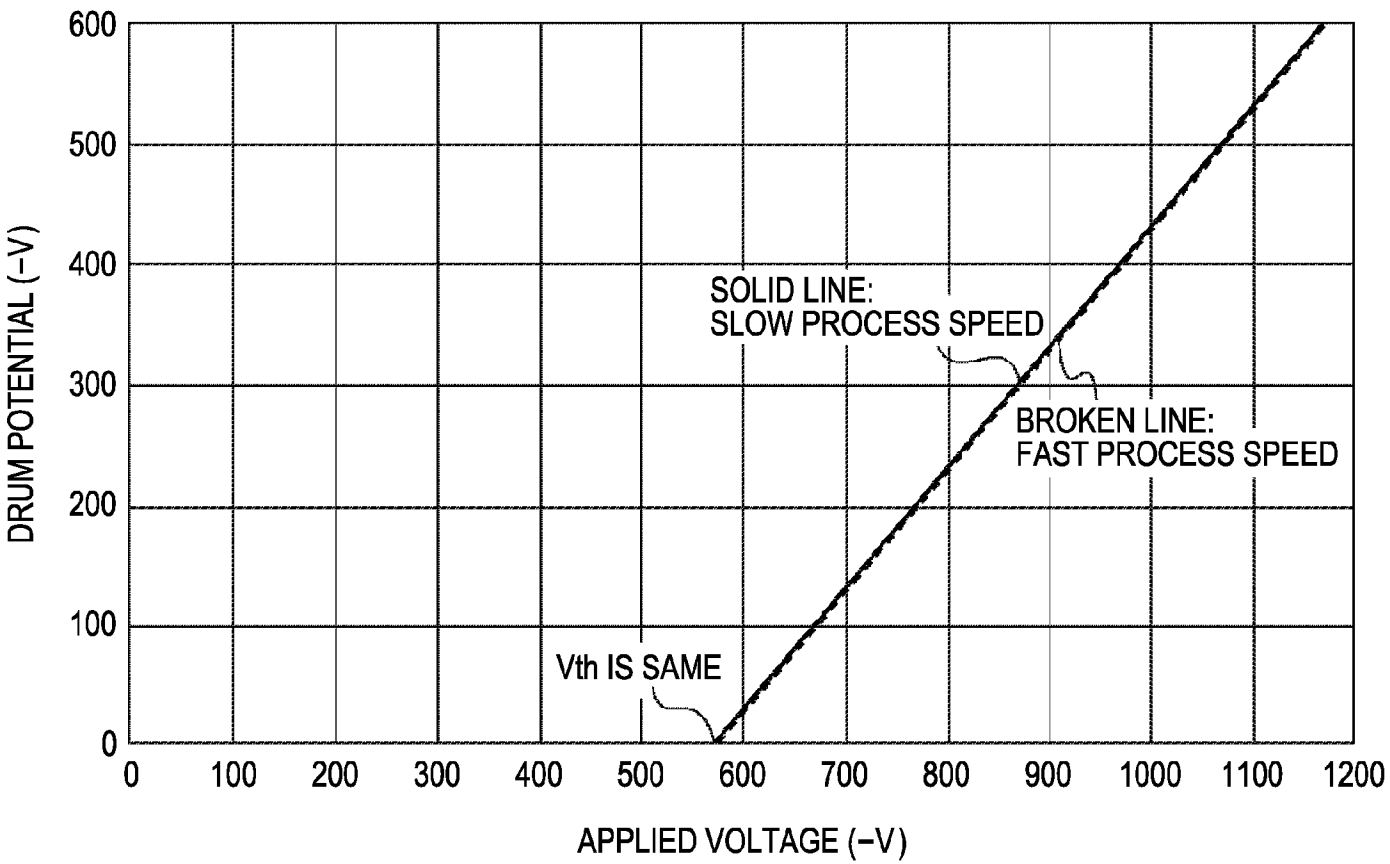
FIG. 2 PRIOR ART
FIG. 2 is a graph showing the relationship between an applied voltage and a drum potential depending on a process speed.
Figure 3:
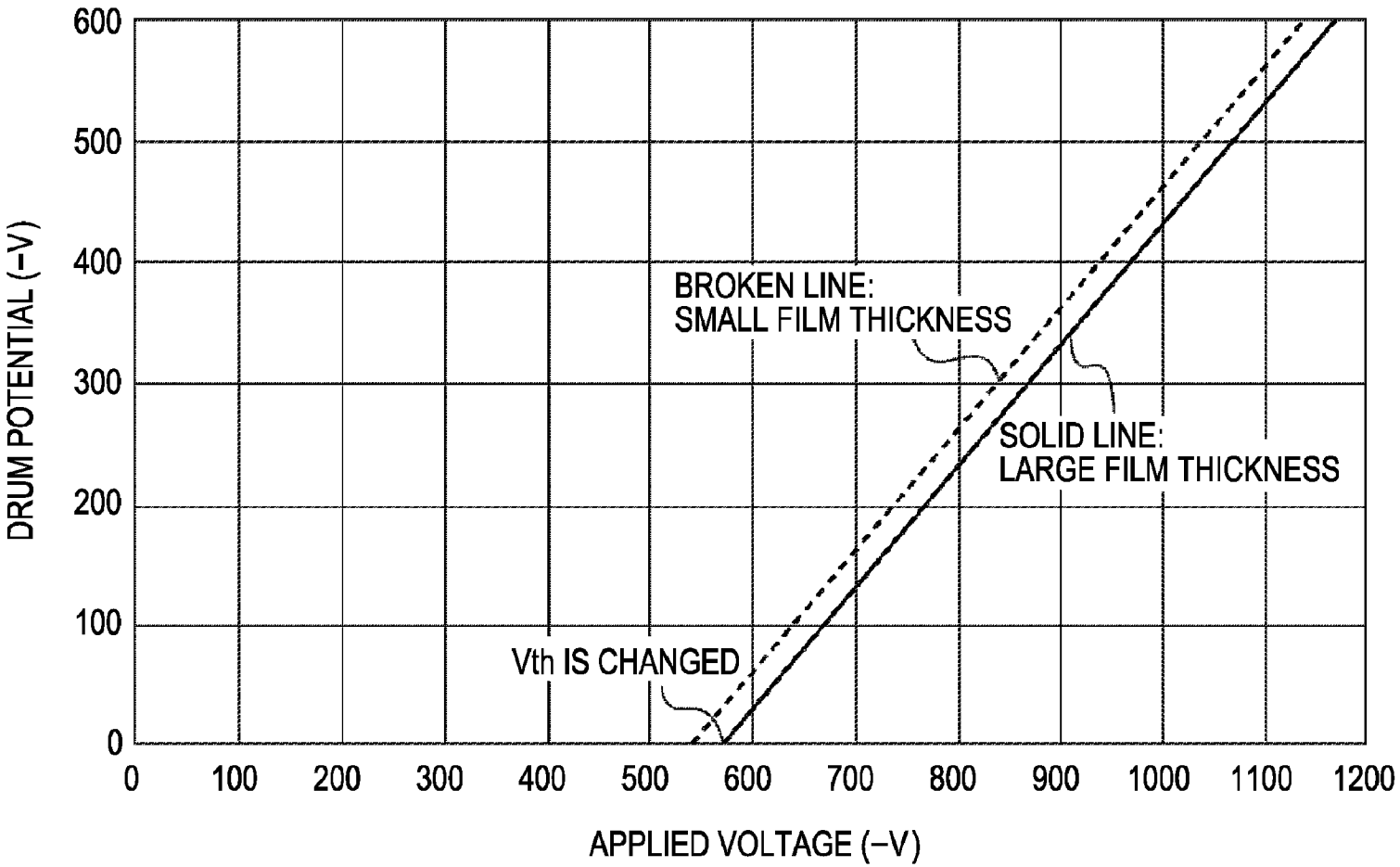
FIG. 3 PRIOR ART
FIG. 3 is a graph showing the relationship between the applied voltage and the drum potential depending on a film thickness of a photosensitive member.
Figure 4:
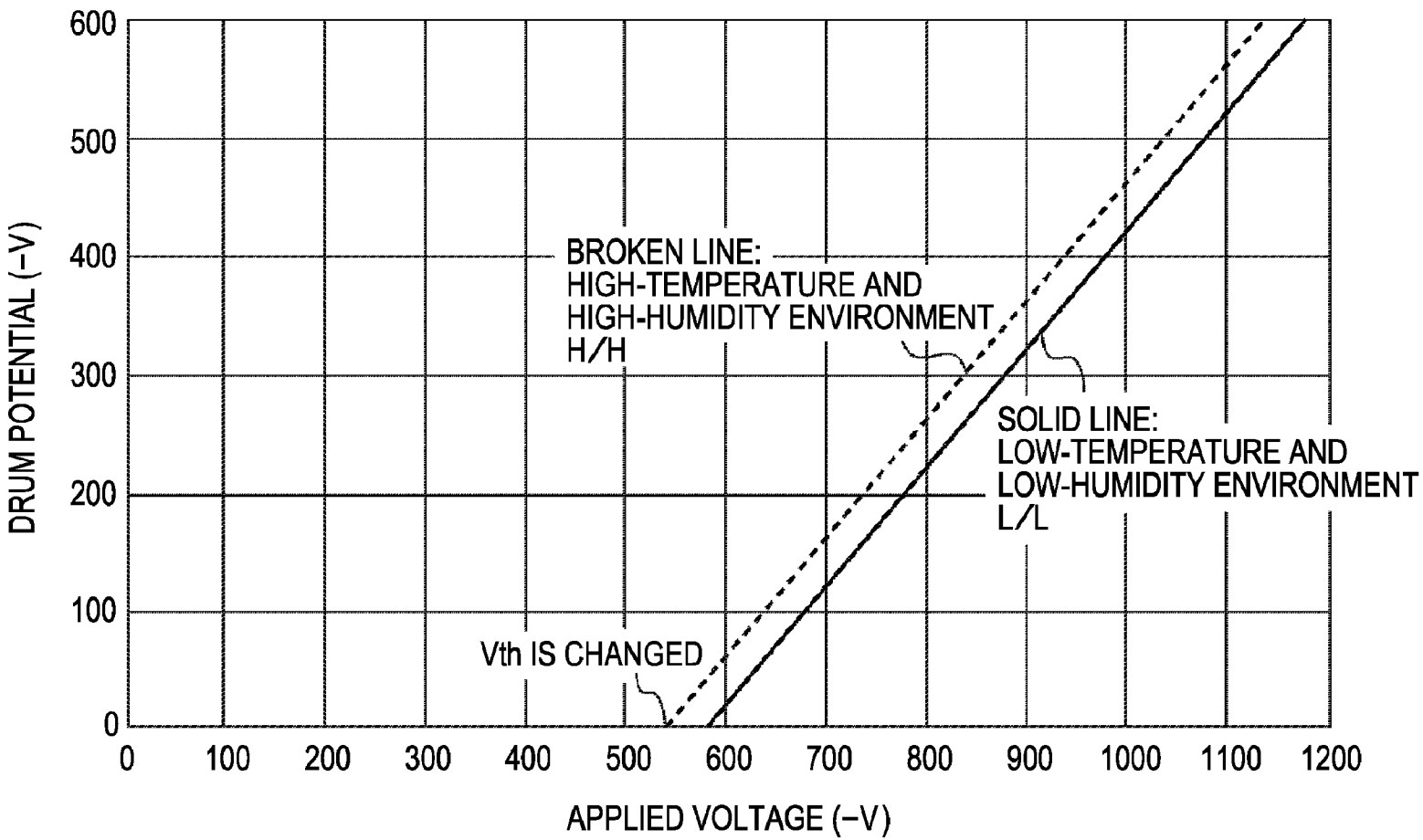
FIG. 4 PRIOR ART
FIG. 4 is a graph showing the relationship between the applied voltage and the drum potential depending on an environment.

FIG. 1 is a schematic vertical sectional view of an image forming apparatus according to a first exemplary embodiment of the present invention.

In FIG. 1, numeral 1 denotes a photosensitive drum which serves as an image bearing member (charged member). The photosensitive drum 1 in the illustrated exemplary embodiment is formed as a cylindrical OPC photosensitive member with a diameter of 30 mm, and it is driven to rotate at a predetermined process speed (peripheral speed) in a clockwise direction, indicated by an arrow X, about a center axis of the drum which is extended vertically to the drawing sheet. In the illustrated exemplary embodiment, the photosensitive drum 1 is rotated at 150 mm/sec. The photosensitive drum 1 is constructed by stacking, on a base layer, a charge generation layer (CG layer) and a charge transfer layer (CT layer) successively.

Numeral 2 denotes a charging roller which serves as a charging roller contacting the photosensitive drum 1. The charging roller 2 is held in close contact with the photosensitive drum 1. The charging roller 2 is rotated together with the rotation of the photosensitive drum 1. A predetermined charging bias is applied to the charging roller 2 from a DC voltage control circuit (HVT, power supply unit) 3 such that the peripheral surface of the photosensitive drum 1 is uniformly charged at a predetermined polarity and potential (negative in the illustrated exemplary embodiment).

A laser beam L modulated in accordance with an image is irradiated (scanned for exposure) by a laser beam scanner 4 to the charged surface of the photosensitive drum 1. With the scanning for exposure, the potential of the photosensitive drum 1 in an exposed area is attenuated so as to form an electrostatic latent image.

When the electrostatic latent image arrives at a developing area, which is positioned to face a developer 5, with the rotation of the photosensitive drum 1, negatively charged toner is supplied from the developer 5 to form a toner image by reversal developing.

A conductive transfer roller 6 is disposed in pressure contact with the photosensitive drum 1 downstream of the developer 5 as viewed in the rotating direction of the photosensitive drum 1. A nip between the photosensitive drum 1 and the transfer roller 6 forms a transfer area.

In match with the timing at which the toner image formed on the surface of the photosensitive drum 1 arrives at the transfer area with the rotation of the photosensitive drum 1, a transfer material (paper) P is supplied to the transfer area with the aid of a guide 7. By applying a predetermined voltage to the transfer roller 6, the toner image is transferred to the transfer material P from the surface of the photosensitive drum 1.

The transfer material P to which the toner image has been transferred in the transfer area is conveyed to a fuser 8 in which the toner image is fused and fixed. Thereafter, the transfer paper P is expelled out of the image forming apparatus.

On the other hand, the surface potential of the photosensitive drum 1 is discharged to a predetermined potential by a pre-exposure unit 11. The toner remaining after the transfer on the surface of the photosensitive drum 1 is scraped off and falls down by a urethane-made counter blade (cleaning blade) 9. Therefore, the surface of the photosensitive drum 1 is cleaned to be ready for the next process of image formation.

Figure 14:
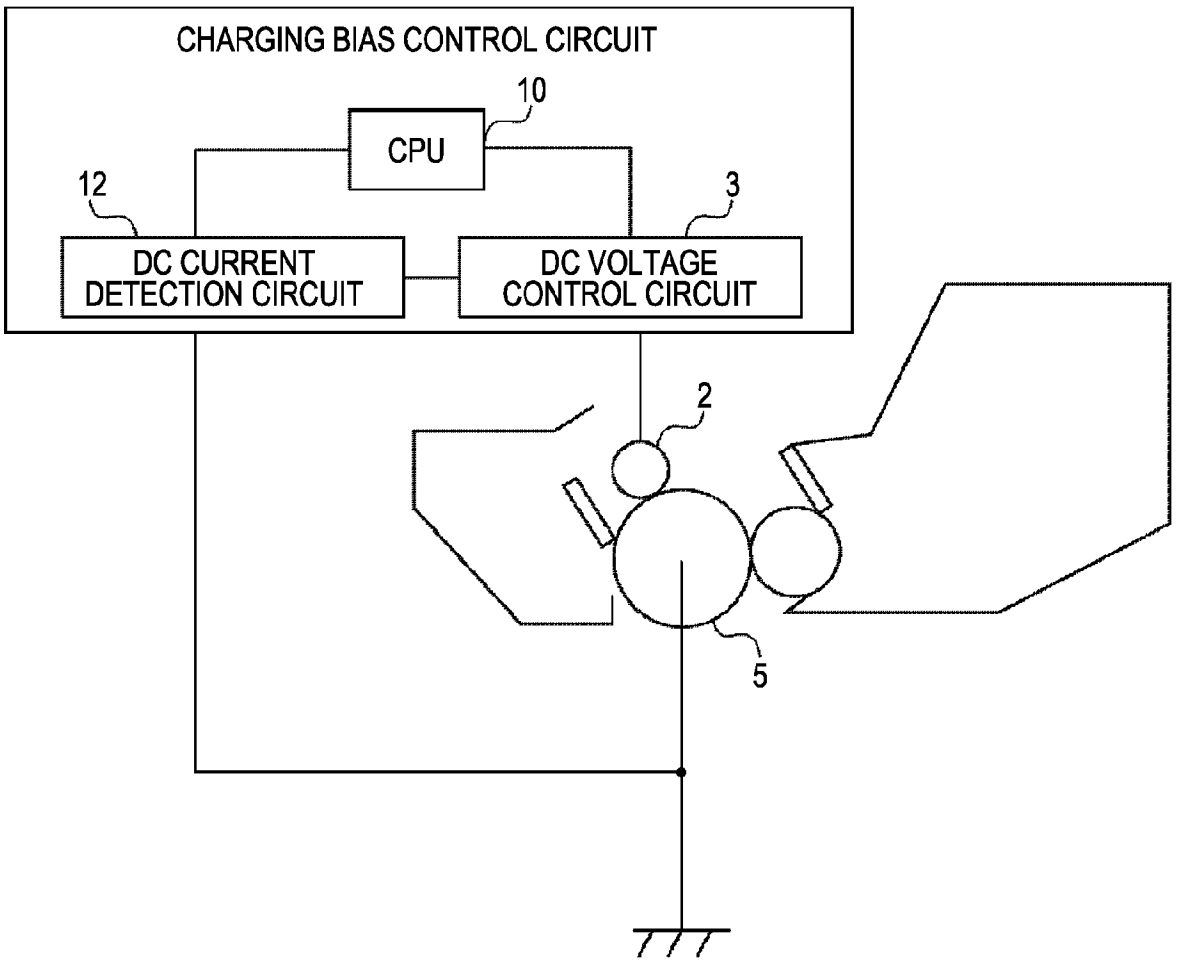
FIG. 14 is a block diagram of a control circuit according to the first exemplary embodiment of the present invention.

Numeral 10 denotes a control unit (CPU). The power supply unit 3 is controlled by the control unit 10. FIG. 14 is a block diagram of a charging bias control circuit.

The problem with the related art, i.e., Japanese Patent No. 3214120, is now described. With the known method of detecting the applied voltage at the time when the small current of not larger than 0.5 μA flows, however, an influence may occur due to a small current that is generated at voltages of not higher than the discharge start voltage. Though described later, a small current may flow even with the application of a voltage of not higher than the discharge start voltage Vth. In a small current region of 2 μA, particularly, a small current flows even when a voltage of not higher than the discharge start voltage Vth is applied. In other words, the known method of detecting the applied voltage at the time when the small current of not larger than 0.5 μA flows has the drawback that Vth is determined to be lower than an actual value and detection accuracy is deteriorated.

As the process speed increases, a charged area of the image bearing member per unit time is increased and a value of the flowing current is also increased. There is hence a possibility that, even by detecting the voltage at the time when the small current of not larger than 0.5 μA flows, the detection accuracy of the discharge start voltage Vth may be changed between the case where the process speed is high and the case where the process speed is low.

The operation flow of the illustrated exemplary embodiment will be described below.

(a) A predetermined voltage is applied between the charging roller 2 and the photosensitive drum 1 in a stepwise manner, and a value of a charging current flowing in the charging member (roller) at that time is detected. A region of the photosensitive drum 1 in which the voltage is applied has been discharged to the predetermined potential by the pre-exposure unit 11.

(b) A discharge stable-start voltage Va is calculated based on the applied voltages and the detected current values, and a discharge start voltage Vth is obtained from Va. The calculation method is described later.

(c) Based on Vth thus obtained, control is executed to apply a voltage V so that a target drum potential Vd is obtained. Herein, the relationship of Vd=V+Vth is held.

The discharge start voltage Vth of the photosensitive drum 1 can be determined by measuring a surface potential Vd of the photosensitive drum 1 and an applied voltage Vdc. However, actually assembling a surface potentiometer for the photosensitive drum results is a more complicated structure and is less cost-effective. Although the surface potentiometer is not required in the present invention, the surface potentiometer is used in the illustrated exemplary embodiment just for the purpose of conducting a proof experiment of a detection method proposed herein.

Figure 5:
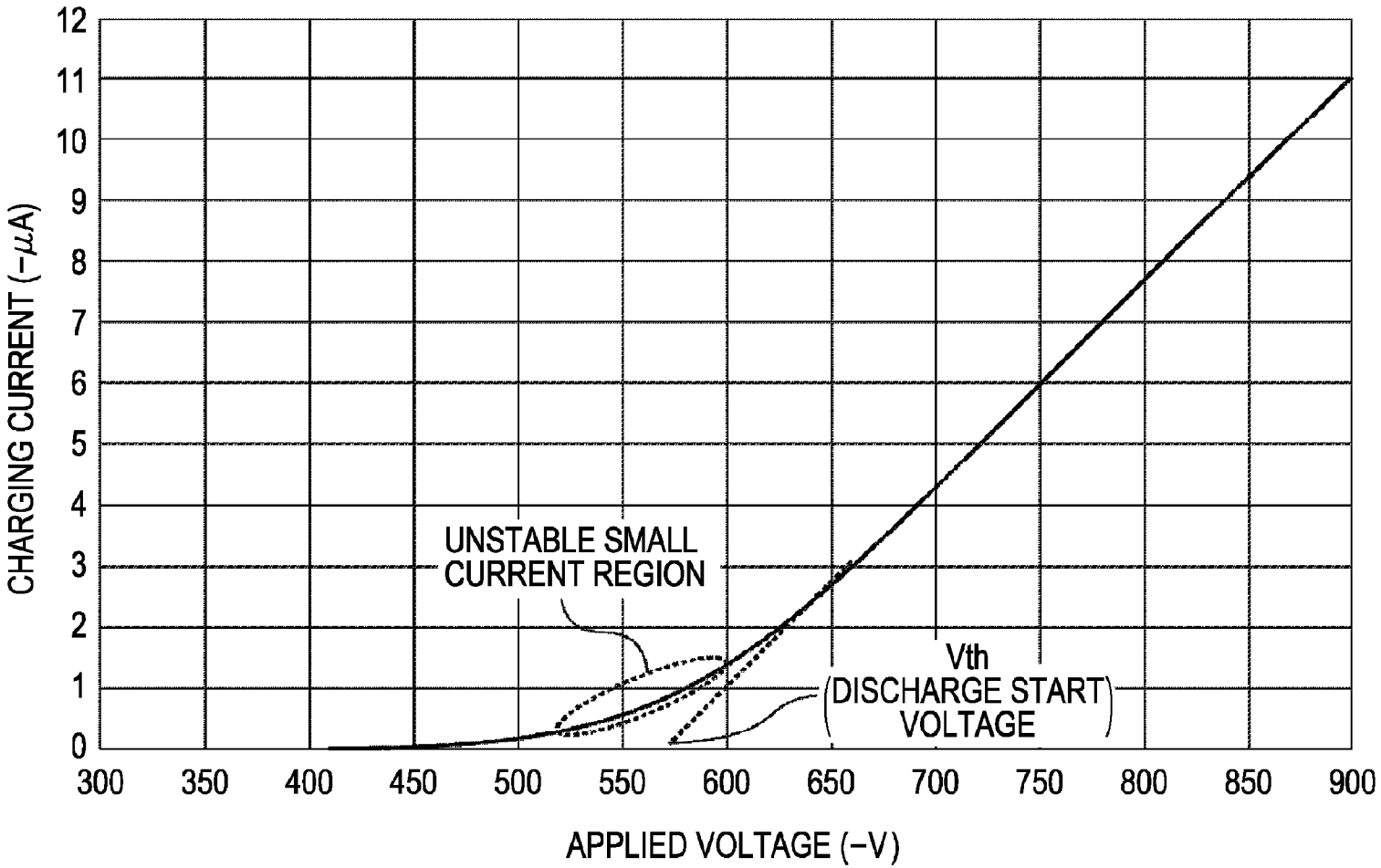
FIG. 5 is a graph showing the relationship between the applied voltage and a charging current in the first exemplary embodiment of the present invention.

Since a current flowing in the charging member and a current flowing in the photosensitive member are substantially the same, the illustrated exemplary embodiment is described as employing a current Id flowing in the photosensitive drum 1, which is easier to measure. FIG. 5 is a graph representing the relationship between the current Id flowing in the photosensitive drum 1 and the applied voltage Vdc. As seen from the graph of FIG. 5, the discharge start voltage Vth of the photosensitive member (drum) can be approximately determined by measuring the current Id flowing in the photosensitive member without measuring the surface potential of the photosensitive member. However, in a current region near the discharge start voltage Vth of the photosensitive member in FIG. 5, particularly in a small current region of not larger than 2 μA, a small current flows even at a voltage of not higher than the discharge start voltage Vth due to the presence of a small and unstable influx current. Stated another way, with the above-described known method of determining, as the discharge start voltage Vth, the voltage measured when a small current of not larger than 0.5 μA flows, Vth is determined to be lower than an actual value and detection accuracy is deteriorated.

To avoid a drawback, the first exemplary embodiment of the present invention proposes a method of detecting the discharge start voltage Vth by measuring the discharge stable-start voltage Va (described later in detail).

First, it is understood from FIG. 5 that the graph can be divided into two regions. One is a region indicated by a curved portion corresponding to the current value of not larger than about 3 μA in which the discharge is unstable (i.e., a region in which a small current flows at a voltage of not higher than the discharge start voltage Vth). The other is a region indicated by a linear portion corresponding to the current value of not smaller than about 3 μA in which the discharge is stable (i.e., a region of not lower than the discharge start voltage Vth).

Figure 6:
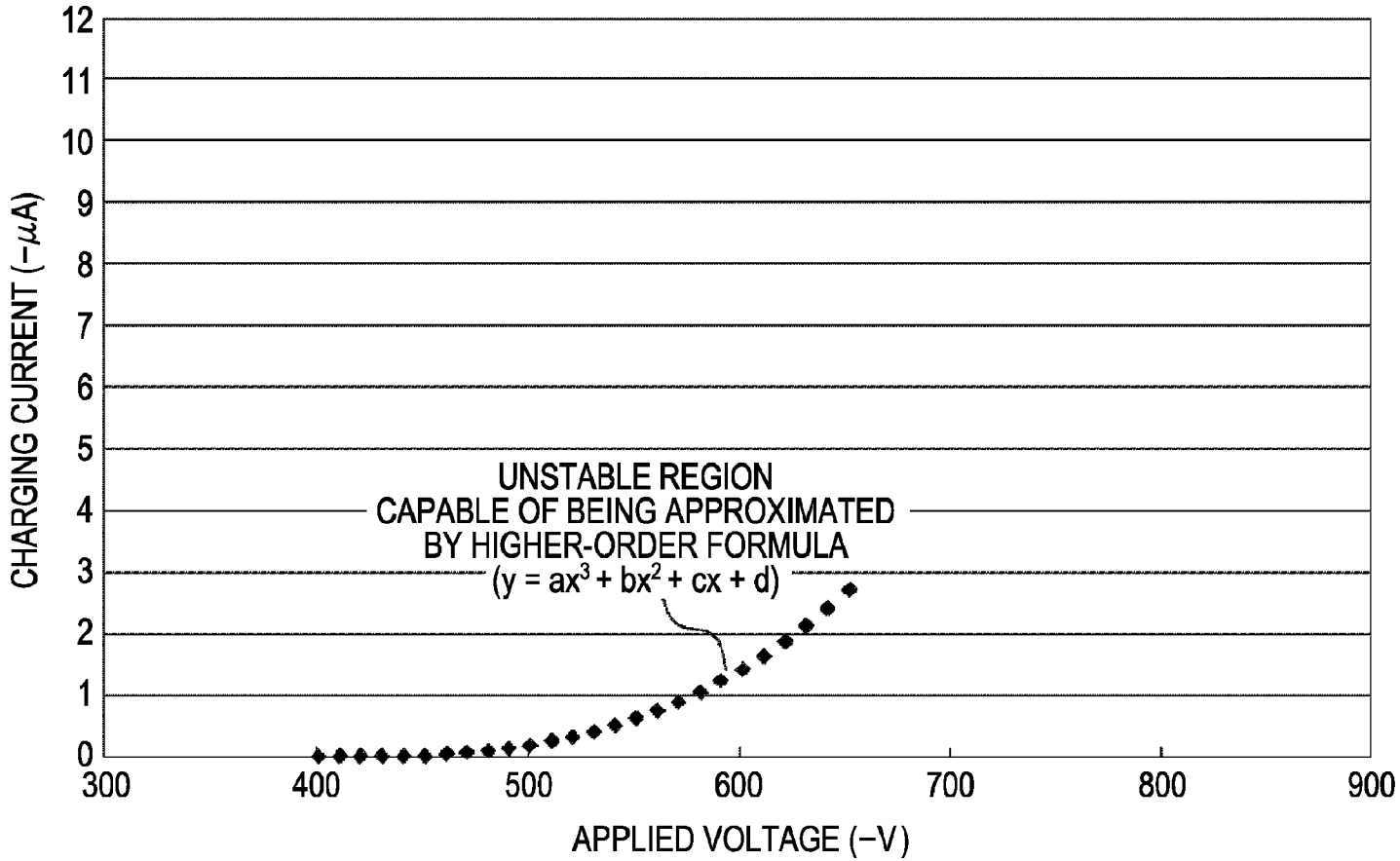
FIG. 6 is a graph showing, in enlarged scale, only a discharge unstable region in FIG. 5 in the first exemplary embodiment of the present invention.
Figure 9:
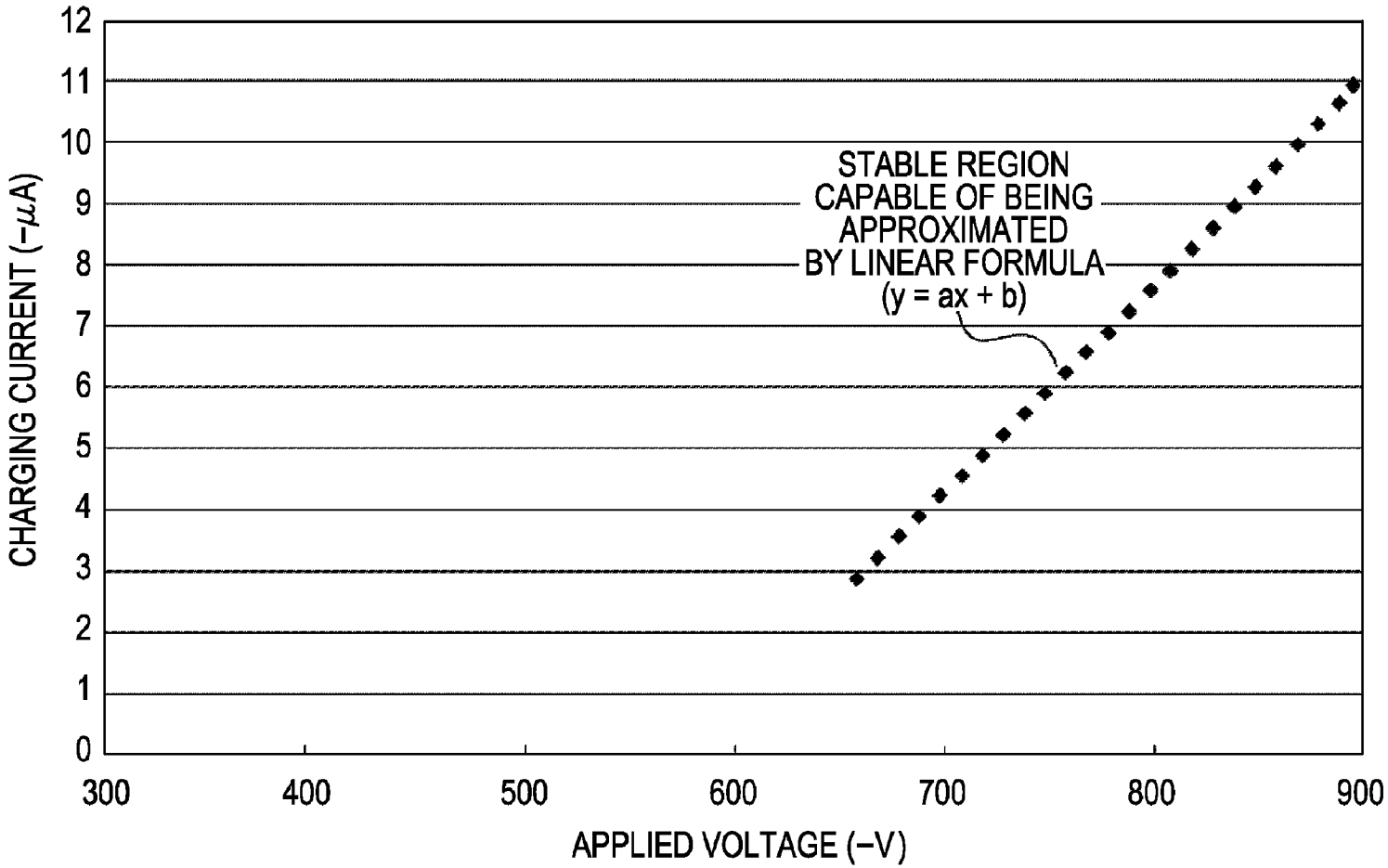
FIG. 9 is a graph showing, in enlarged scale, only the discharge unstable region in FIG. 5 in the first exemplary embodiment of the present invention.

The two regions in FIG. 5 are shown in FIGS. 6 and 9, respectively. More specifically, FIG. 6 is a graph representing, in the extracted form, the region in which the discharge is unstable. The profile of the graph, shown in FIG. 6, can be approximated by a higher-order formula of $y=ax^3+bx^2+cx+d$ (formula of three degree in the illustrated exemplary embodiment). Also, FIG. 9 is a graph representing, in the extracted form, the region in which the discharge is stable. The profile of the graph, shown in FIG. 9, can be approximated by a linear formula of y=ax+b.

Figure 7:
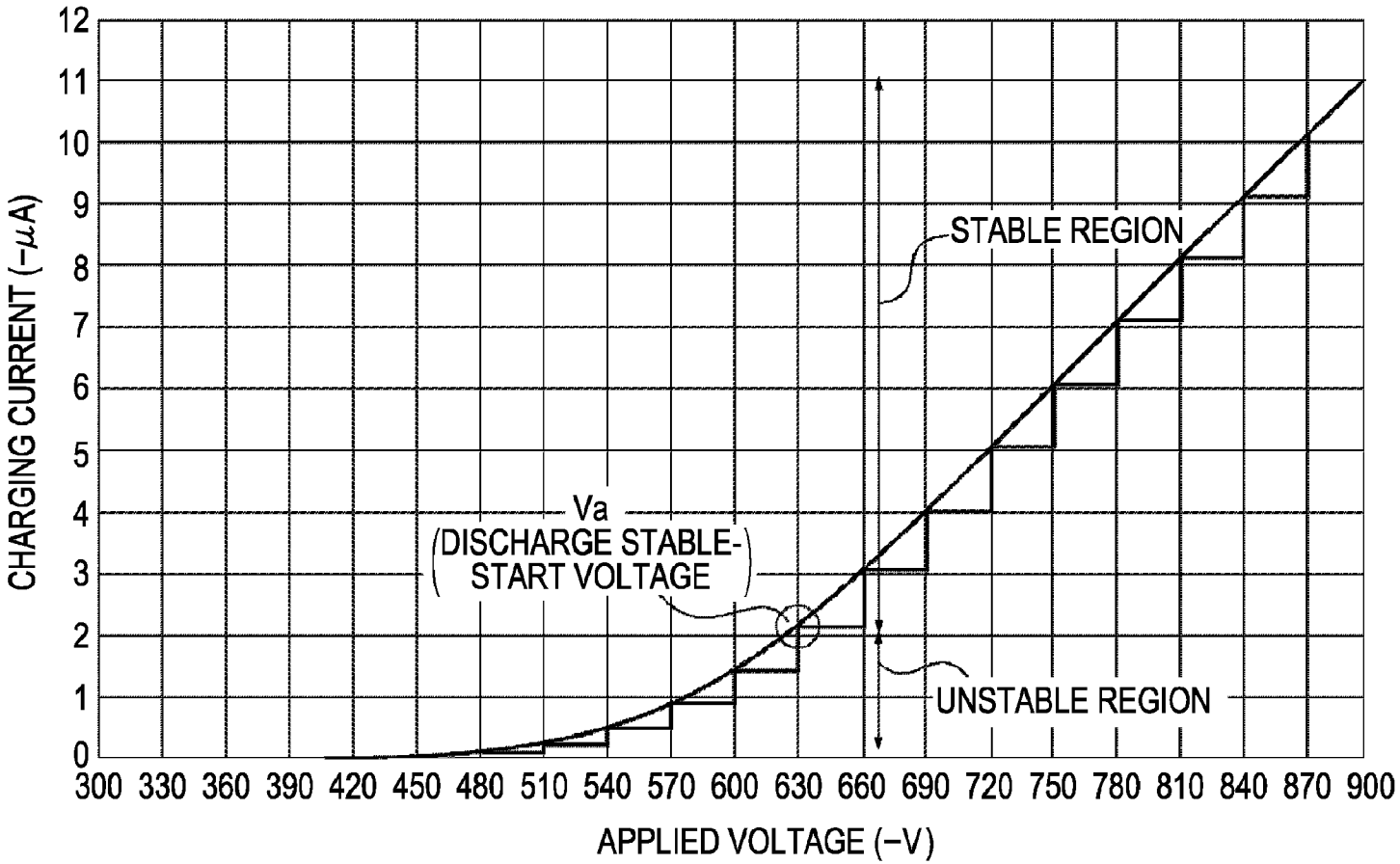
FIG. 7 is a graph showing an increase of a current value when a constant voltage is set so as to increase step by step in the first exemplary embodiment of the present invention.

The discharge stable-start voltage Va, which is given by a voltage corresponding to the boundary between the two regions represented by those numerical formulae, is detected as follows. As shown in FIG. 7, the voltage applied to the charging roller is increased step by step (in units of −30 V), and a current flowing with the application of the voltage in each step is detected. The discharge stable-start voltage Va is obtained as a voltage (boundary voltage) at which a change amount of a current value with respect to the applied voltage (i.e., a gradient of the graph of FIG. 7) is transited from an increase to a predetermined value. More specifically, as seen from FIG. 7, when the applied voltage is increased step by step, the change amount of the current with respect to the voltage is increased in the region where the discharge is unstable. Thereafter, when coming into the region where the discharge is stable, the change amount of the current with respect to the voltage becomes constant from an increasing trend. The applied voltage at the boundary at which the change amount of the current with respect to the voltage becomes constant is determined to be the discharge stable-start voltage Va.

Figure 8:
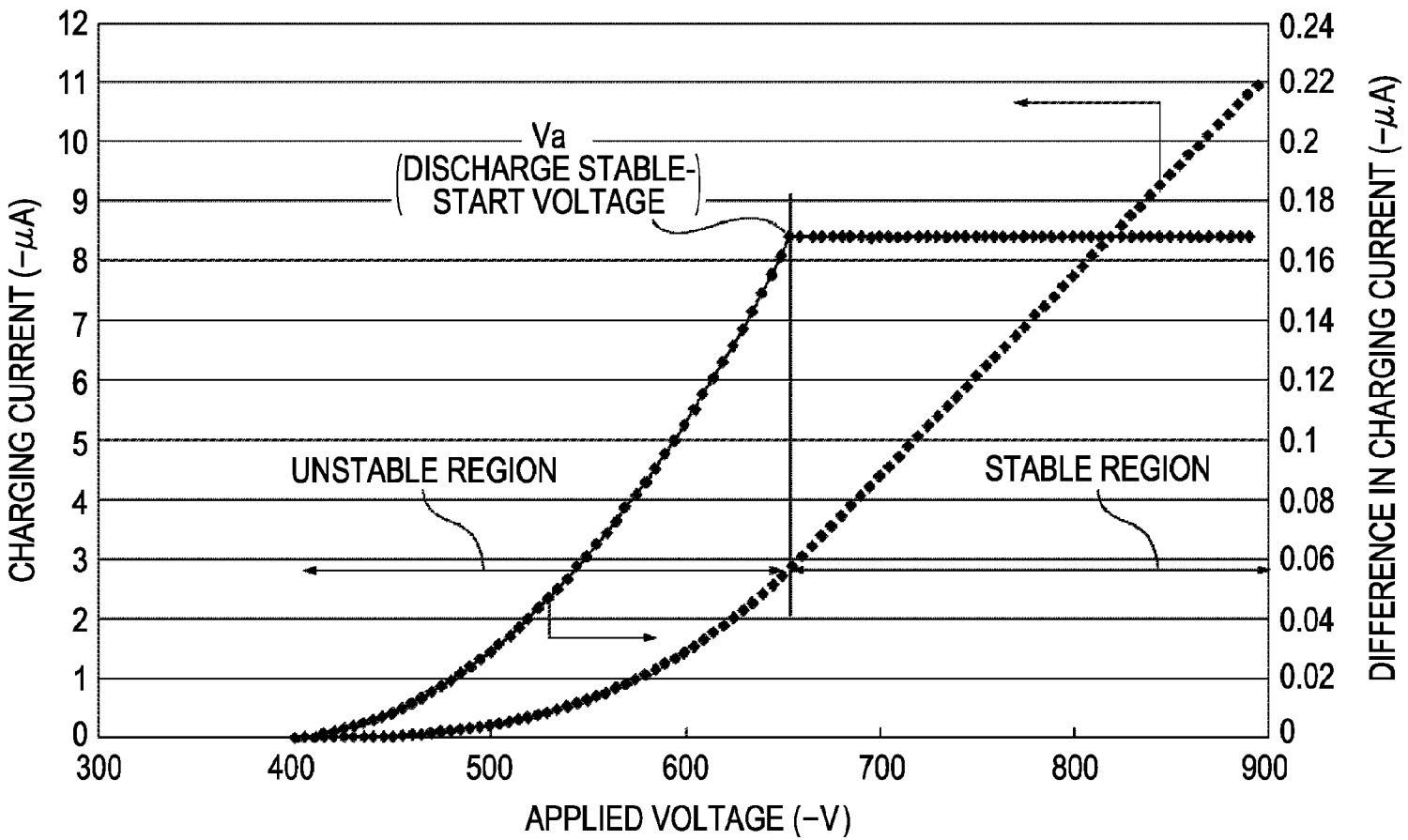
FIG. 8 is a graph showing an increase of the current value and a discharge stable-start voltage when the constant voltage is set so as to increase step by step in the first exemplary embodiment of the present invention.

The above point will be described in more detail with reference to FIG. 8. FIG. 8 is a graph plotting, in addition to the graph of FIG. 7, a difference in the charging current value with a vertical axis on the right side indicating the difference in the charging current value. In other words, the additionally plotted graph is a graph resulting from first order differentiation of the current versus voltage graph. Thus, by detecting a point at which the difference in the charging current value becomes constant, the discharge stable-start voltage Va can be obtained. While the point at which the change amount of the current with respect to the voltage becomes constant is detected in FIGS. 7 and 8, the discharge stable-start voltage Va can also given as a point at which that change amount becomes not larger than a certain threshold. Further, the point at which the change amount of the current with respect to the voltage becomes constant can be obtained by detecting a point at which a change amount of change in a DC current with respect to change in a DC voltage becomes 0. When the change amount of change in the DC current with respect to change in the DC voltage is plotted in a graph, the graph is resulted from second order differentiation of the current versus voltage graph. In the second order differential graph, the region where the change amount of the current with respect to the voltage becomes constant (i.e., the stable region in FIG. 7) is represented by 0. Thus, the discharge stable-start voltage Va can also be determined by obtaining the point at which the change amount of change in the DC current with respect to change in the DC voltage becomes 0.

Comparing the thus-obtained discharge stable-start voltage Va and the discharge start voltage Vth obtained from the surface potentiometer, a relationship of |Va|−|Vth|=70 V is resulted. The discharge start voltage Vth is obtained as follows. A voltage Vroller is applied to the charging roller to charge the photosensitive drum so as to cause discharge, and a potential Vdrum of the photosensitive drum at the start of the discharge is measured by the surface potentiometer. The discharge start voltage Vth is obtained from the relationship of Vdrum−Vroller=Vth.

In the illustrated exemplary embodiment, without using the surface potentiometer, the discharge start voltage Vth can be obtained by determining the discharge stable-start voltage Va and subtracting a correction value α=70 V (|Vth|=|Va|−70 V) from Va. When the discharge start voltage Vth is obtained with high accuracy in such a manner, the voltage Vdc to be applied to the charging roller can be obtained from a calculation formula of Vdc=Vd+Vth with high accuracy on condition that the desired potential of the photosensitive drum in the image formation is Vd. Accordingly, control can be performed so as to achieve the target potential Vd of the photosensitive drum by determining the discharge stable-start voltage Va, adding a predetermined voltage (reference voltage) to Va, and applying the summed voltage to the charging roller.

Experiments were conducted to check a match between the discharge start voltage Vth obtained from the discharge stable-start voltage Va as in the present invention and the discharge start voltage Vth measured by the surface potentiometer when the process speed, the film thickness of the photosensitive member, and the environment were actually changed.

EXPERIMENT 1

(1) When Process Speed is Changed

Figure 10:
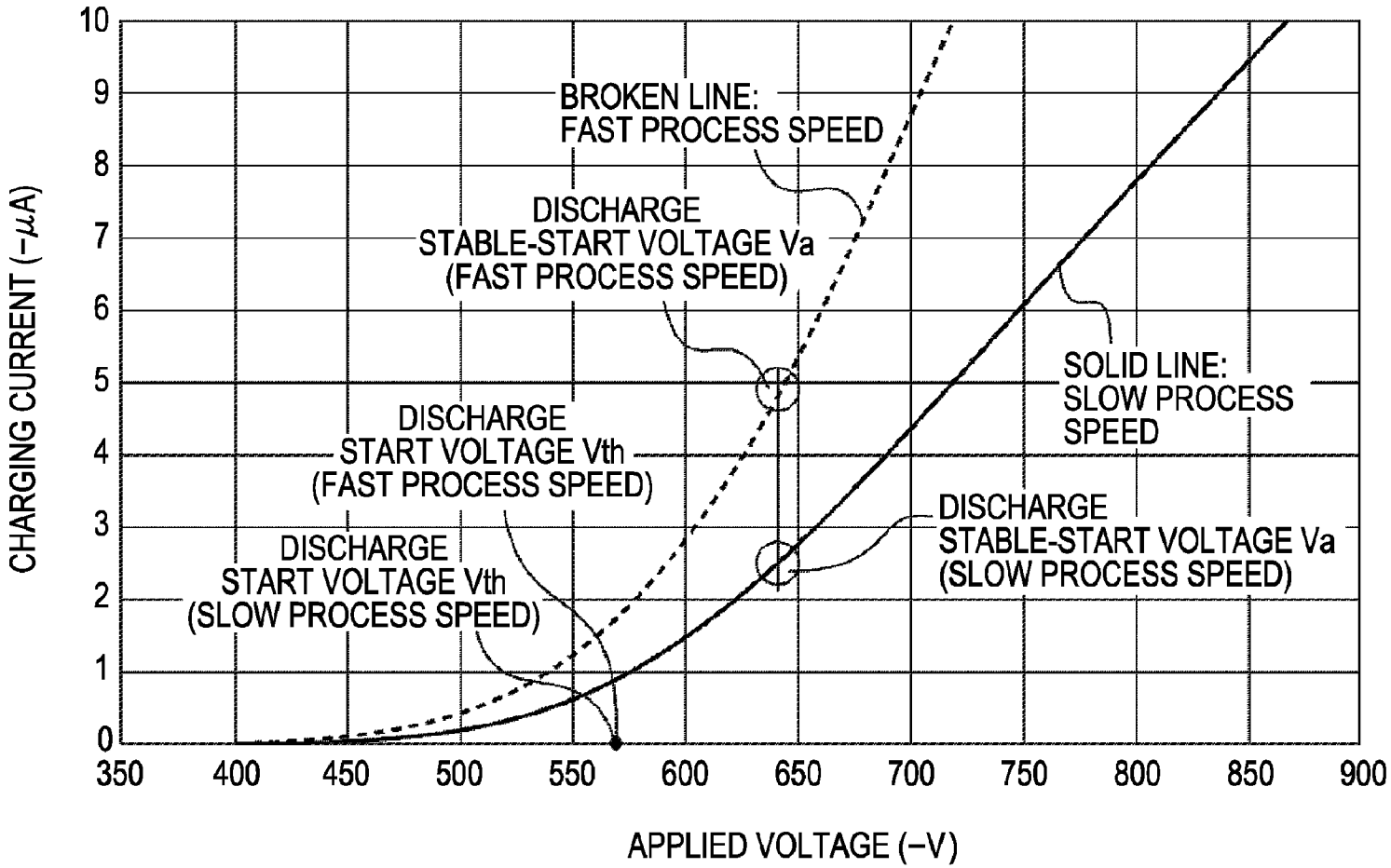
FIG. 10 is a graph showing the relationship between a discharge start voltage and the discharge stable-start voltage depending on the process speed in the first exemplary embodiment of the present invention.

FIG. 10 is a graph plotting the relationship between the applied voltage and the charging current when the process speed is fast, i.e., 300 mm/sec, and when it is slow, i.e., 150 mm/sec. If the process speed is changed, a charged area is also changed such that the charged area is proportional to the current. Therefore, when the process speed is fast, the charging current is increased, and when the process speed is slow, the charging current is reduced. Further, it is premised, as described above, that the discharge start voltage Vth is not changed even when the process speed is changed. In other words, it can be said that if the discharge stable-start voltage Va is also not changed depending on the process speed, the principle of the present invention is theoretically correct. In this experiment, the discharge stable-start voltage Va was obtained by using the detection method described above with reference to FIG. 8 and the discharge start voltage Vth was obtained from Va while the process speed was set to different values. The other conditions than the process speed were set in common. Namely, the film thickness of the photosensitive drum was set to 30 μm and the environment was set to the L/L environment. Note that, in this exemplary embodiment, the film thickness of the photosensitive drum represents the thickness of the CT layer (charge transfer layer). The experiment results are shown in Table 1. As seen from table 1, at each process speed, the discharge start voltage Vth calculated by using Va was substantially the same value as that actually measured by using the surface potentiometer. Also, the discharge stable-start voltage Va was not changed depending on the process speed.

TABLE 1

| Process speed | Discharge start voltage Vth measured by surface potentiometer | Discharge start voltage Vth | Discharge stable-start voltage Va | Va-Vth |
|---|---|---|---|---|
| 300 mm/sec | −570 V | −570 V | −640 V | 70 V |
| 150 mm/sec | −570 V | −570 V | −640 V | 70 V |
| Difference in Vth, Va due to process speed difference | 0 V | 0 V | 0 V | — |

Thus, it is understood that the discharge start voltage Vth can be obtained with high accuracy by determining the discharge stable-start voltage Va according to the principle of the present invention, and that the photosensitive drum can be charged to the target potential Vd by adding the predetermined voltage to the discharge stable-start voltage Va.

EXPERIMENT 2

(2) When Film Thickness of Photosensitive Drum is Changed

Figure 11:
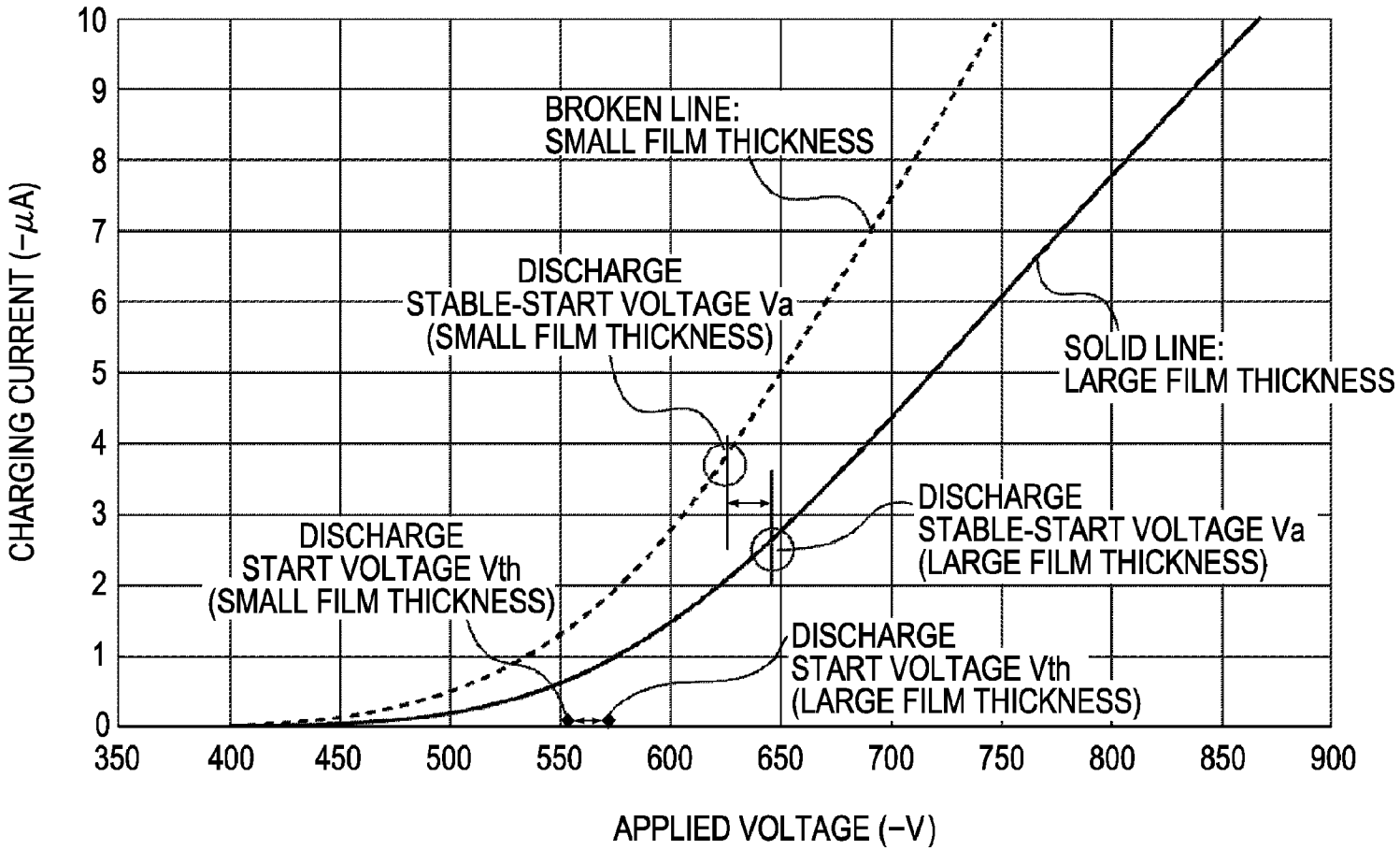
FIG. 11 is a graph showing the relationship between the discharge start voltage and the discharge stable-start voltage depending on the film thickness of the photosensitive member in the first exemplary embodiment of the present invention.

FIG. 11 is a graph plotting the relationship between the applied voltage and the charging current when the film thickness of the photosensitive drum is large, i.e., 15 μm, and when it is small, i.e., 30 μm. If the film thickness of the photosensitive drum is changed, the impedance of the photosensitive drum is changed and the discharge start voltage Vth is also changed. More specifically, when the film thickness is small, the charging current is increased and Vth is lowered, and when the film thickness is large, the charging current is reduced and Vth is raised. Thus, it can be said that if the discharge stable-start voltage Va is also changed similarly to the discharge start voltage Vth, the principle of the present invention is theoretically correct.

For each of the photosensitive drums having different film thicknesses, the discharge stable-start voltage Va was obtained by using the detection method described above with reference to FIG. 8 and the discharge start voltage Vth was obtained from Va. The other conditions than the film thickness of the photosensitive drum were set in common. Namely, the process speed was set to 150 mm/sec and the environment was set to the L/L environment. The experiment results are shown in Table 2. As seen from table 2, at each film thickness, the discharge start voltage Vth calculated by using Va was substantially the same value as that actually measured by using the surface potentiometer. Also, the discharge stable-start voltage Va was reduced as the film thickness of the photosensitive drum is decreased. This means that the experiment provides the same result as the theoretical result.

TABLE 2

| Film thickness of photosensitive drum | Discharge start voltage Vth measured by surface potentiometer | Discharge start voltage Vth | Discharge stable-start voltage Va | Va-Vth |
|---|---|---|---|---|
| 15 μm | −555 V | −555 V | −625 V | 70 V |
| 30 μm | −570 V | −570 V | −640 V | 70 V |
| Difference in Vth, Va due to film thickness difference | 15 V | 15 V | 15 V | — |

Thus, it is understood that the discharge start voltage Vth can be obtained with high accuracy by determining the discharge stable-start voltage Va according to the principle of the present invention, and that the photosensitive drum can be charged to the target potential Vd by adding the predetermined voltage to the discharge stable-start voltage Va.

EXPERIMENT 3

(3) Environment is Changed

Figure 12:
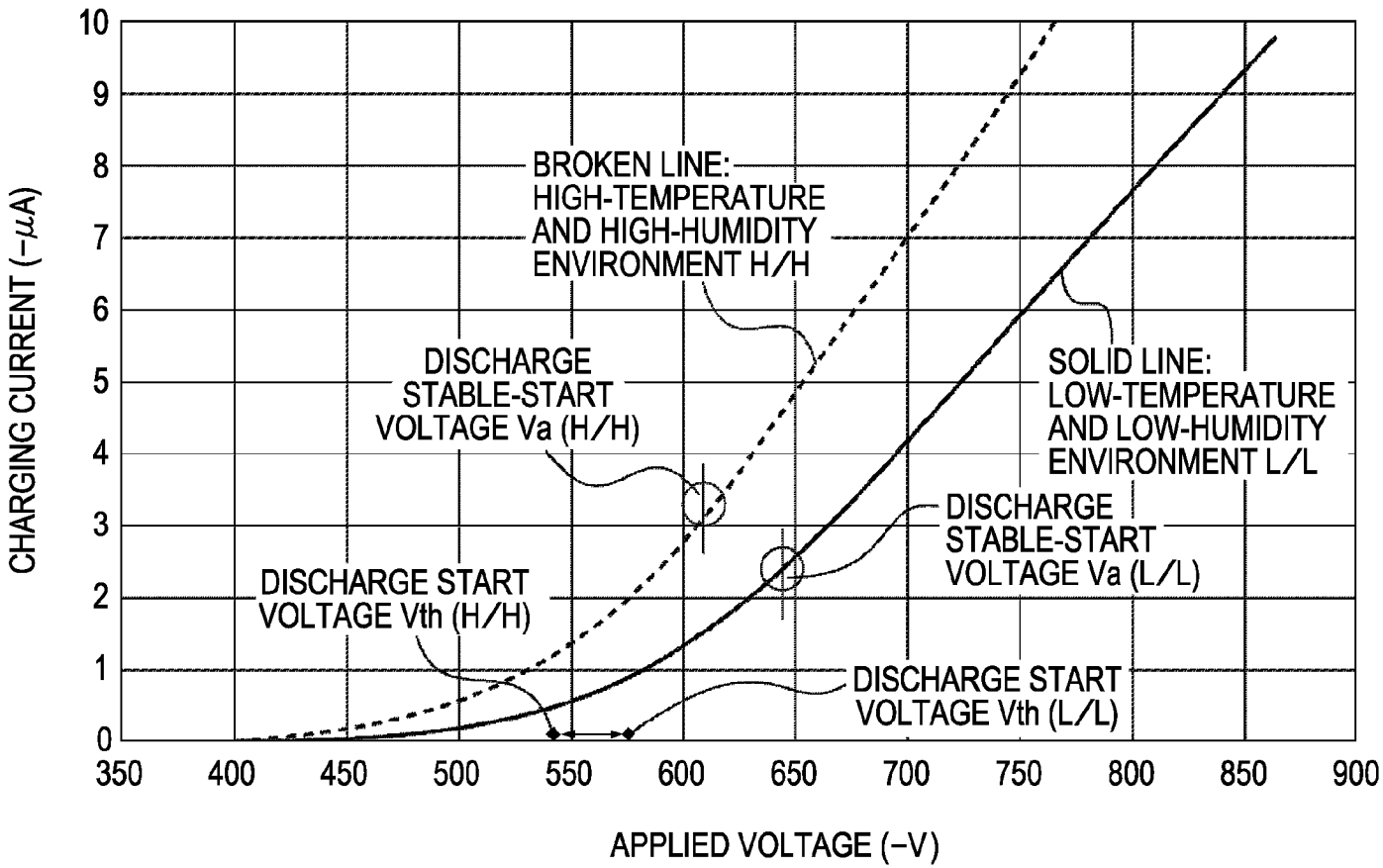
FIG. 12 is a graph showing the relationship between the discharge start voltage and the discharge stable-start voltage depending on an environment in the first exemplary embodiment of the present invention.

FIG. 12 is a graph plotting the relationship between the applied voltage and the charging current when the environment is set to the high-temperature and high-humidity (H/H) environment and when it is set to the low-temperature and low-humidity (L/L) environment. If the environment is changed, the impedance of the charging roller is changed and the discharge start voltage Vth is also changed. More specifically, in the high-temperature and high-humidity (H/H) environment, the charging current is increased and Vth is lowered, and in the low-temperature and low-humidity (H/H) environment, the charging current is reduced and Vth is raised. Thus, it can be said that if the discharge stable-start voltage Va is also changed similarly to the discharge start voltage Vth, the principle of the present invention is theoretically correct.

In each of different environmental states (i.e., in each of the L/L environment and the H/H environment), the discharge stable-start voltage Va was determined by using the detection method described above with reference to FIG. 8 and the discharge start voltage Vth was obtained from Va. The other conditions than the environment were set in common. Namely, the process speed was set to 150 mm/sec and the film thickness of the photosensitive drum was set to 30 μm. The experiment results are shown in Table 3. As seen from table 3, in each environment, the discharge start voltage Vth calculated by using Va was substantially the same value as that actually measured by using the surface potentiometer. Also, the discharge stable-start voltage Va was reduced in the H/H environment. This means that the experiment provides the same result as the theoretical result.

TABLE 3

| Environment | Discharge start voltage Vth measured by surface potentiometer | Discharge start voltage Vth | Discharge stable-start voltage Va | Va-Vth |
|---|---|---|---|---|
| High-temperature and high-humidity (H/H) | −540 V | −540 V | −610 V | 70 V |
| Low-temperature and low-humidity (L/L) | −570 V | −570 V | −640 V | 70 V |
| Difference in Vth, Va due to environmental difference | 30 V | 30 V | 30 V | — |

Thus, it is understood that the discharge start voltage Vth can be obtained with high accuracy by determining the discharge stable-start voltage Va according to the principle of the present invention, and that the photosensitive drum can be charged to the target potential Vd by adding the predetermined voltage to the discharge stable-start voltage Va.

In this exemplary embodiment, the correction value used to obtain the discharge start voltage Vth from the discharge stable-start voltage Va is described as being 70 V in the above experiments (1), (2) and (3). However, the correction value is not limited to 70 V. The difference between the discharge stable-start voltage Va and the discharge start voltage Vth is a value depending on the photosensitive drum, the charging roller, etc. Accordingly, the correction value differs for each of image forming apparatuses.

Thus, the above experiments have proved that the discharge start voltage Vth can be obtained with high accuracy by determining the discharge stable-start voltage Va even when any of the process speed, the film thickness of the photosensitive drum, and the environment is changed. Also, the photosensitive drum can be charged to the target potential Vd by adding the predetermined voltage to the discharge stable-start voltage Va.

EXAMPLE 1

A practical example will be described below. An image forming apparatus of this example has substantially the same construction of the image forming apparatus which is used in the verification experiments and is illustrated in the schematic vertical sectional view of FIG. 1.

The image forming apparatus of this example is described with reference to FIG. 1. Numeral 1 denotes a photosensitive drum which serves as an image bearing member (charged member). The photosensitive drum 1 in this example is formed as a cylindrical OPC photosensitive member with a diameter of 30 mm, and it is driven to rotate at a predetermined process speed (peripheral speed) in a clockwise direction, indicated by an arrow X, about a center axis of the drum which is extended vertically to the drawing sheet. In this example, the photosensitive drum 1 is rotated at 150 mm/sec. The photosensitive drum 1 is constructed by stacking, on a base layer, a charge generation layer (CG layer) and a charge transfer layer (CT layer) successively.

Numeral 2 denotes a charging roller which serves as a charging member contacting the photosensitive drum 1. The charging roller 2 is rotated together with the rotation of the photosensitive drum 1. A predetermined charging bias is applied to the charging roller 2 from a DC voltage control circuit (HVT, power supply unit) 3 such that the peripheral surface of the photosensitive drum 1 is uniformly charged at a predetermined polarity and potential (negative in this example).

A laser beam L modulated in accordance with an image is irradiated (scanned for exposure) by a laser beam scanner 4 to the charged surface of the photosensitive drum 1. With the scanning for exposure, the potential of the photosensitive drum 1 in an exposed area is attenuated so as to form an electrostatic latent image.

When the electrostatic latent image arrives at a developing area, which is positioned to face a developer 5, with the rotation of the photosensitive drum 1, negatively charged toner is supplied from the developer 5 to form a toner image by reversal developing.

A conductive transfer roller 6 is disposed in pressure contact with the photosensitive drum 1 downstream of the developer 5 as viewed in the rotating direction of the photosensitive drum 1. A nip between the photosensitive drum 1 and the transfer roller 6 forms a transfer area.

In match with the timing at which the toner image formed on the surface of the photosensitive drum 1 arrives at the transfer area with the rotation of the photosensitive drum 1, a transfer material (paper) P is supplied to the transfer area with the aid of a guide 7. By applying a predetermined voltage to the transfer roller 6, the toner image is transferred to the transfer material P from the surface of the photosensitive drum 1.

The transfer material P to which the toner image has been transferred in the transfer area is conveyed to a fuser 8 in which the toner image is fused and fixed. Thereafter, the transfer paper P is expelled out of the image forming apparatus.

On the other hand, the surface potential of the photosensitive drum 1 is discharged to a predetermined potential by a pre-exposure unit 11. The toner remaining after the transfer on the surface of the photosensitive drum 1 is scraped off and fallen down by a urethane-made counter blade (cleaning blade) 9. Therefore, the surface of the photosensitive drum 1 is cleaned to be ready for the next process of image formation.

Numeral 10 denotes a control unit (CPU). The DC current detection circuit 12 and the power supply unit (DC voltage control circuit) 3 are controlled by the control unit 10. FIG. 14 is a block diagram of a charging bias control circuit.

The operation flow of this example will be described below.

Figure 13:
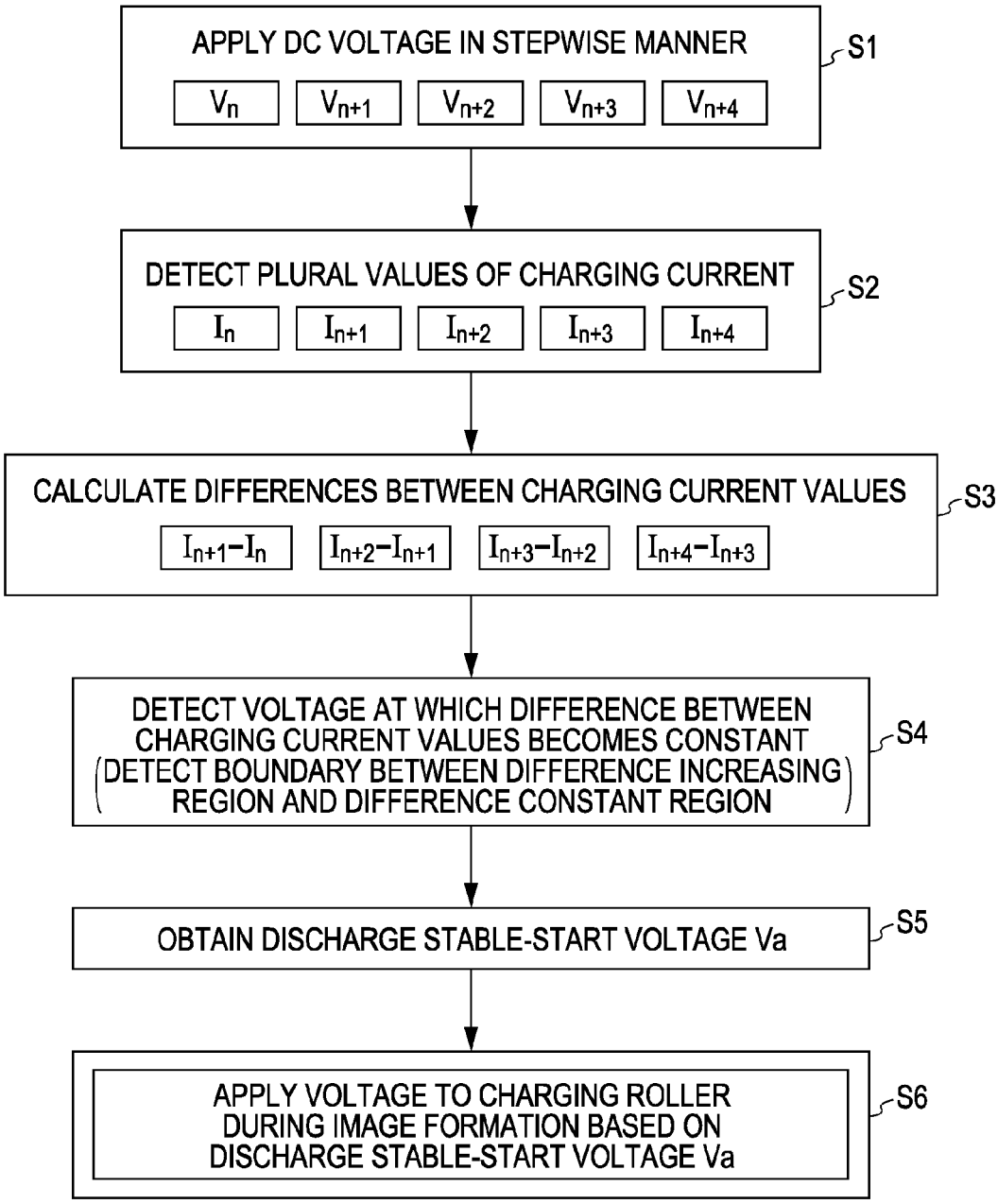
FIG. 13 is a flowchart of the control operation according to the first exemplary embodiment of the present invention.

A voltage control method can be performed by controlling the voltage, which is applied to the charging roller, in accordance with a flowchart shown in FIG. 13.

A plurality of DC voltages having different magnitudes are successively applied step by step (e.g., Vn, Vn+1, Vn+2, . . . ) during a period of no image formation to measure a plurality of currents (e.g., In, In+1, In+2, . . . ) which flow in the charging roller upon the application of the respective DC voltages (S1 and S2). Herein, the term the "period of no image formation" means a period during which the toner image is not formed on the photosensitive drum 1. More specifically, the period of no image formation indicates, for example, a period of preparatory operation after turning-on of a power switch of the image forming apparatus (i.e., a preceding multi-rotation period) and a period of preparatory operation from turning-on of a print signal to start of the image formation (i.e., a preceding rotation period).

Differences in the charging current (e.g., In+1−In, In+2−In+1, . . . ), i.e., differences between values of two successively measured charging currents, are calculated to obtain each change amount of the current with respect to the voltage (S3).

Then, the voltage at the boundary where the difference in the changing current becomes constant from an increasing trend is detected as the discharge stable-start voltage Va (S4 and S5).

Based on Va thus detected, the applied voltage Vdc is applied to the charging roller during the period of image formation (S6). More specifically, the predetermined voltage is added to Va to set the applied voltage Vdc so that the desired target potential Vd of the photosensitive drum is obtained. Assuming, in this example, the correction value to be 70 V, as well as Va=−640 V, Vth=−570 V and Vd=−600 V, it is understood, from the relationship of $$|Vdc|=|Vd|+|Vth|=|Vd|+(|Va|-70\ (\mathrm{V}))$$

that a voltage of −1170 V is required to be applied to the charging roller during the period of image formation.

Because the discharge stable-start voltage Va is a value smaller than the voltage usually applied during the period of image formation, a voltage applied to determine Va during the period of image formation is also small. Therefore, the voltage to be applied to the charging roller during the period of image formation can be decided without causing discharge during the period of no image formation to a larger extent than a necessary level. As a result, the influence of abrasion of the photosensitive drum caused by the discharge can be suppressed. In particular, it is more desirable to apply the voltage in a gradually increasing order from a small value to a large value during the period of no image formation, and to stop the application of the voltage immediately at the time when the discharge stable-start voltage Va is detected. Such control is advantageous in that there is no need of applying a large voltage.

According to the present invention, as described above, a plurality of different DC voltages are successively applied during the period of no image formation, and DC currents flowing in the charging member upon the application of the respective DC voltages are detected. The successive voltage application is continued until a change amount of the DC current with respect to the DC voltage becomes constant. In other words, a plurality of different DC voltages are successively applied until a change amount of change in the DC current with respect to change in the DC voltage becomes 0. Based on the result detected by a current detection unit, the control unit controls the DC voltage that is applied to the charging member during the period of image formation. In the above-described example, the control unit determines the point (discharge stable-start voltage) Va at which the change amount of change in the DC current with respect to change in the DC voltage becomes 0. Further, the control unit applies a voltage, which is obtained by adding a reference voltage to Va, to the charging member during the period of image formation so that the photosensitive drum 1 can be charged to the desired potential.

In the above-described example, for the purpose of determining the discharge stable region, the plurality of different DC voltages are successively applied until the change amount of change in the DC current with respect to change in the DC voltage becomes 0. However, the present invention is not limited to such a method. As another example, the DC voltages can be successively applied until the change amount of change in the DC current with respect to change in the DC voltage becomes not larger than a predetermined value, based on the consideration that the discharge comes into the stable region at the time when the change amount of the DC current with respect to the DC voltage becomes substantially constant (e.g., almost 0).

Further, in the above-described example, Vth is given as a value obtained by determining the discharge stable-start voltage Va and then subtracting the correction value of 70 V from Va. However, the method of calculating Vth is not limited to the above-described one. As another example, the discharge start voltage Vth can also be obtained by extending a linear line from two points within a region of not smaller than the discharge stable-start voltage Va based on the relationship between the current Id and the applied voltage Vdc, shown in FIG. 5, and by determining a point at which the extended linear line crosses the axis representing the applied voltage Vdc.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2006-336009 filed Dec. 13, 2006 and Japanese Application No. 2007-270085 filed Oct. 17, 2007, which are hereby incorporated by reference herein in its entirety.

What is claimed is:

1. An image forming apparatus comprising:

an image bearing member arranged to bear an electrostatic latent image;

a charging member contacting the image bearing member to charge a surface of the image bearing member with application of a DC voltage to the charging member;

a current detection unit arranged to detect a DC current flowing in the charging member; and a control unit configured to control the voltage applied to the charging member, wherein a plurality of different voltages are applied during a period of no image formation until a difference in absolute value between a first amount and a second amount becomes not larger than a predetermined value, where In, In+1 and In+2 are DC currents detected by the current detection unit when a plurality of different voltages are applied to the charging member, the first amount is an amount of change in a current with respect to change in a voltage obtained from In and In+1, and the second amount is an amount of change in current with respect to change in voltage obtained from In+2 and In+1, and the control unit controls a DC voltage applied to the charging member during a period of image formation based on a result detected by the current detection unit during a period of no image formation.

2. The image forming apparatus according to claim 1, wherein the voltage applied during the period of image formation is controlled based on a current in a region in which the difference in absolute value between the first amount and the second amount becomes not larger than the predetermined value.

3. The image forming apparatus according to claim 1, wherein the voltage applied during the period of image formation is given as a voltage obtained by adding a reference voltage to a boundary voltage, the boundary voltage is a DC voltage when the difference in absolute value between the first amount and the second amount becomes not larger than the predetermined value.

4. The image forming apparatus according to claim 1, wherein when the plurality of different DC voltages are applied to the charging member during the period of no image formation, the applied voltages are increased step by step from a small value to a large value, and the application of the DC voltage is ended at a time when a boundary voltage is obtained, the boundary voltage is a DC voltage when the difference in absolute value between the first amount and the second amount becomes not larger than the predetermined value.

* * * * *